US006178752B1

(12) United States Patent
Morford

(10) Patent No.: US 6,178,752 B1
(45) Date of Patent: Jan. 30, 2001

(54) DURABILITY FLAME STABILIZING FUEL INJECTOR WITH IMPINGEMENT AND TRANSPIRATION COOLED TIP

(75) Inventor: Stephen A. Morford, Jupiter, FL (US)

(73) Assignee: United Technologies Corporation, Hartford, CT (US)

( * ) Notice: Under 35 U.S.C. 154(b), the term of this patent shall be extended for 0 days.

(21) Appl. No.: 09/046,903

(22) Filed: Mar. 24, 1998

(51) Int. Cl.[7] ..... F02C 7/20

(52) U.S. Cl. ..... 60/737; 60/748; 239/403; 239/424.5

(58) Field of Search ..... 60/39.06, 737, 60/748, 757; 239/400, 403, 419, 419.3, 424.5; 431/173

(56) References Cited

U.S. PATENT DOCUMENTS

| | | | | |
|---|---|---|---|---|
| 2,266,834 | * | 12/1941 | Walker et al. | 239/424.5 |
| 3,545,903 | * | 12/1970 | McCullough | 239/424.5 |
| 5,121,608 | * | 6/1992 | Willis et al. | 60/737 |
| 5,288,021 | * | 2/1994 | Sood et al. | 239/400 |
| 5,319,923 | * | 6/1994 | Leonard et al. | 60/737 |
| 5,444,982 | * | 8/1995 | Heberling et al. | 60/737 |
| 5,467,926 | * | 11/1995 | Idleman et al. | 60/737 |
| 5,535,953 | * | 7/1996 | Huhne et al. | 239/419.3 |
| 5,671,597 | * | 9/1997 | Butler et al. | 60/737 |
| 5,899,076 | * | 5/1999 | Snyder et al. | 60/748 |

* cited by examiner

*Primary Examiner*—Ted Kim
(74) *Attorney, Agent, or Firm*—Kenneth C. Baran

(57) ABSTRACT

The invention is a tangential entry, premixing fuel injector (10) for the combustion chamber (30) of a turbine engine. The injector includes a pair of arcuate scrolls (18) defining the radially outer boundary of a mixing chamber (28) and a pair of air entry slots (36) for admitting a stream of primary combustion air tangentially into the mixing chamber. The scrolls also include an axially distributed array of primary fuel injection passages (42) for injecting a primary fuel into the primary air stream. A flame stabilizing fuel injector centerbody (46) includes an impingement and transpiration cooled outlet nozzle (50) for introducing secondary fuel and secondary air into the combustion chamber. The nozzle (50) includes an impingement plate(74) with an array of impingement ports (76) and a tip cap (104) with an array of discharge passages (106). The impingement ports and discharge passages are in series flow, misaligned relationship so that secondary air exiting from the impingement ports impinges on the tip cap and flows through the core discharge passages to impingement cool and transpiration cool the nozzle. The disclosed injector runs cooler than a more conventional tangential entry injector and therefore is more durable. The improved durability is achieved even though the disclosed injector uses less cooling air than a more conventional tangential entry injector and discharges the cooling air at a lower velocity. The reduced cooling air quantity helps to minimize carbon monoxide emissions and the reduced discharge velocity improves the spatial and temporal stability of the combustion flame.

11 Claims, 3 Drawing Sheets

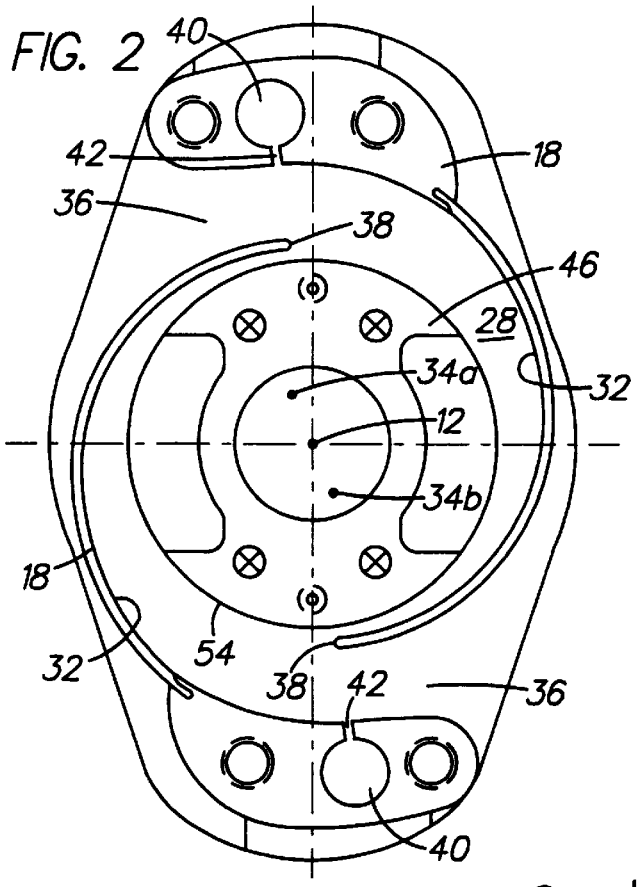
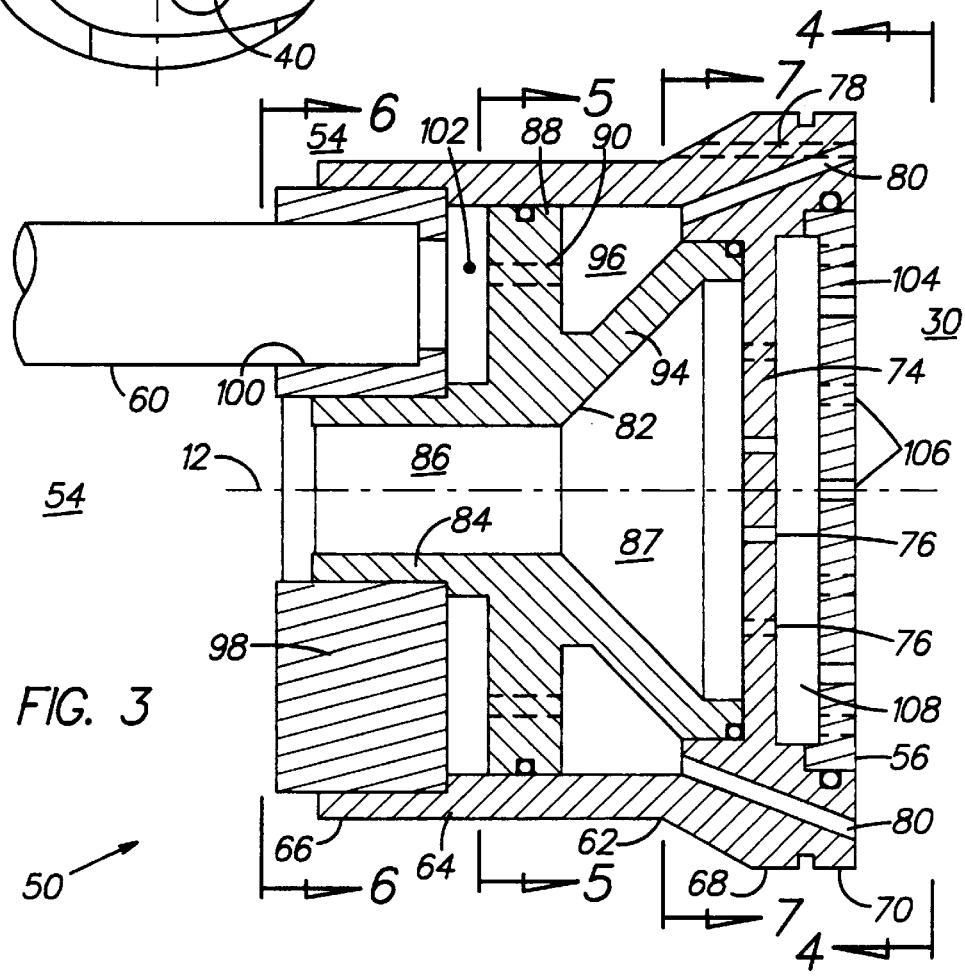
FIG. 3

DURABILITY FLAME STABILIZING FUEL INJECTOR WITH IMPINGEMENT AND TRANSPIRATION COOLED TIP

CROSS REFERENCE TO RELATED APPLICATIONS

This application contains subject matter related to commonly owned copending U.S. patent application Ser. No. 08/771,408 entitled "Flame Disgorging Two Stream Tangential Entry Nozzle" filed on Dec. 20, 1996, U.S. Ser. No. 08/771,409 entitled "Method of Disgorging Flames from a Two Stream Tangential Entry Nozzle" filed on Dec. 20, 1996 and U.S. Ser. No. 08/991,032 entitled "Bluff Body Premixing Fuel Injector and Method for Premixing Fuel and Air", filed on Dec. 15, 1997.

TECHNICAL FIELD

This invention relates to premixing fuel injectors for gas turbine engine combustion chambers, and particularly to an injector having an advanced cooling arrangement that improves injector durability and enhances combustion flame stability without increasing carbon monoxide emissions.

BACKGROUND OF THE INVENTION

Combustion of fossil fuels produces a number of undesirable pollutants including oxides of nitrogen (NOx) and carbon monoxide (CO). Environmental degradation attributable to NOx and CO has become a matter of increasing concern, leading to intense interest in suppressing NOx and CO formation in fuel burning devices.

One of the principal strategies for inhibiting NOx formation is to burn a fuel-air mixture that is both stoichiometrically lean and thoroughly blended. Lean stoichiometry and thorough blending keep the combustion flame temperature uniformly low—a prerequisite for inhibiting NOx formation. One type of fuel injector that produces a lean, thoroughly blended fuel-air mixture is a tangential entry injector. Examples of tangential entry fuel injectors for gas turbine engines are provided in U.S. Pat. Nos. 5,307,643, 5,402,633, 5,461,865 and 5,479,773, all of which are assigned to the assignee of the present application. These fuel injectors have a mixing chamber radially outwardly bounded by a pair of cylindrical-arc, offset scrolls. Adjacent ends of the scrolls define air admission slots for admitting air tangentially into the mixing chamber. An array of fuel injection passages extends axially along the length of each slot. A fuel injector centerbody extends aftwardly from the forward end of the injector to define the radially inner boundary of the mixing chamber. The centerbody may include provisions for introducing additional fuel into the mixing chamber. During engine operation, a stream of combustion air enters the mixing chamber tangentially through the air admission slots while fuel is injected into the air stream through each of the fuel injection passages. The fuel and air swirl around the centerbody and become intimately and uniformly intermixed in the mixing chamber. The fuel-air mixture flows axially aftwardly and is discharged into an engine combustion chamber where the mixture is ignited and burned. The intimate, uniform premixing of the fuel and air in the mixing chamber inhibits NOx formation by ensuring a uniformly low combustion flame temperature.

Despite the many merits of the tangential entry injectors referred to above, they are not without certain shortcomings. One shortcoming is that the fuel-air mixture in the mixing chamber can encourage the combustion flame to migrate into the mixing chamber where the flame can quickly damage the scrolls and centerbody. A second shortcoming is related to the flame's tendency to be spatially and temporally unstable even if it remains outside the mixing chamber. This flame instability, which is formally known as an aerothermal acoustic resonance, is manifested by fluctuations in the position of the flame and accompanying, low frequency pressure oscillations. The repetitive character of the pressure oscillations can stress the combustion chamber, compromising its structural integrity and reducing its useful life. An improved tangential entry fuel injector that addresses these shortcomings is described in U.S. patent application Ser. No. 08/991,032 filed on Dec. 15, 1997 and assigned to the assignee of the present application. The disclosed injector includes a unique array of fuel injection passages for injecting fuel into the tangentially entering airstream, and an aerodynamically contoured centerbody featuring a bluff tip aligned with the injector's discharge plane. Fuel and air discharge openings extend through the centerbody tip for discharging jets of fuel and air into the combustion chamber at the injector discharge plane. The passage array and centerbody shape cooperate to resist flame ingestion and disgorge any flame that becomes ingested. The bluff, fueled tip provides a surface for anchoring the combustion flame, improving the flame's stability and further counteracting any tendency of the flame to migrate into the mixing chamber. The air flowing through the air discharge openings in the tip helps to support combustion and cool the tip.

Although the improved injector addresses the problems of flame stability and flame ingestion, the durability of the injector may be inadequate for extended, trouble free service. Because the centerbody tip is directly exposed to the anchored combustion flame, the tip operates at temperatures high enough to limit its useful life. The velocity and quantity of cooling air flowing through the tip passages could be increased to improve the temperature tolerance of the tip. However increasing the cooling air velocity tends to destabilize the combustion flame by weakening its propensity to remain attached to the tip. Increasing the cooling air quantity is also undesirable because the cooling air not only cools the tip but also reduces the flame temperature. Although low flame temperature suppresses NOx formation, a flame that is too cool also inhibits a combustion reaction that converts carbon monoxide to more environmentally benign carbon dioxide. Thus, although NOx emissions may be satisfactory, CO emissions may be unacceptably high.

What is sought is an advanced, premixing fuel injector that balances the conflicting demands of good durability and superior flame stability without increasing CO emissions.

SUMMARY OF THE INVENTION

It is, therefore, an object of the invention to provide a premixing fuel injector that inhibits NOx and CO formation, stabilizes the combustion flame, and exhibits superior durability.

According to the invention a premixing fuel injector includes a flame stabilizing centerbody with an impingement and transpiration cooled discharge nozzle. The superior effectiveness of the impingement and transpiration cooling improves the temperature tolerance of the injector, making it suitable for extended, trouble free operation. Because the cooling arrangement is highly effective, the cooling air velocity is modest enough to ensure stability of the combustion flame. Likewise the required quantity of cooling air is moderate enough that CO emissions remain acceptably low.

According to one aspect of the invention, the nozzle also includes a fuel distribution chamber and a fuel manifold interconnected by an orifice array to ensure that secondary fuel is uniformly distributed among a multitude of fuel discharge passages.

The foregoing features and the construction and operation of the invention will become more apparent in light of the following description of the best mode for carrying out the invention and the accompanying drawings.

BRIEF DESCRIPTION OF THE DRAWINGS

FIG. 2 is an end view of the injector taken substantially in the direction 2—2 of FIG. 1.

FIG. 3 is an enlarged cross sectional view of a fuel and air discharge nozzle positioned at the aft end of the fuel injector of FIG. 1.

BEST MODE FOR CARRYING OUT THE INVENTION

Figure 1:
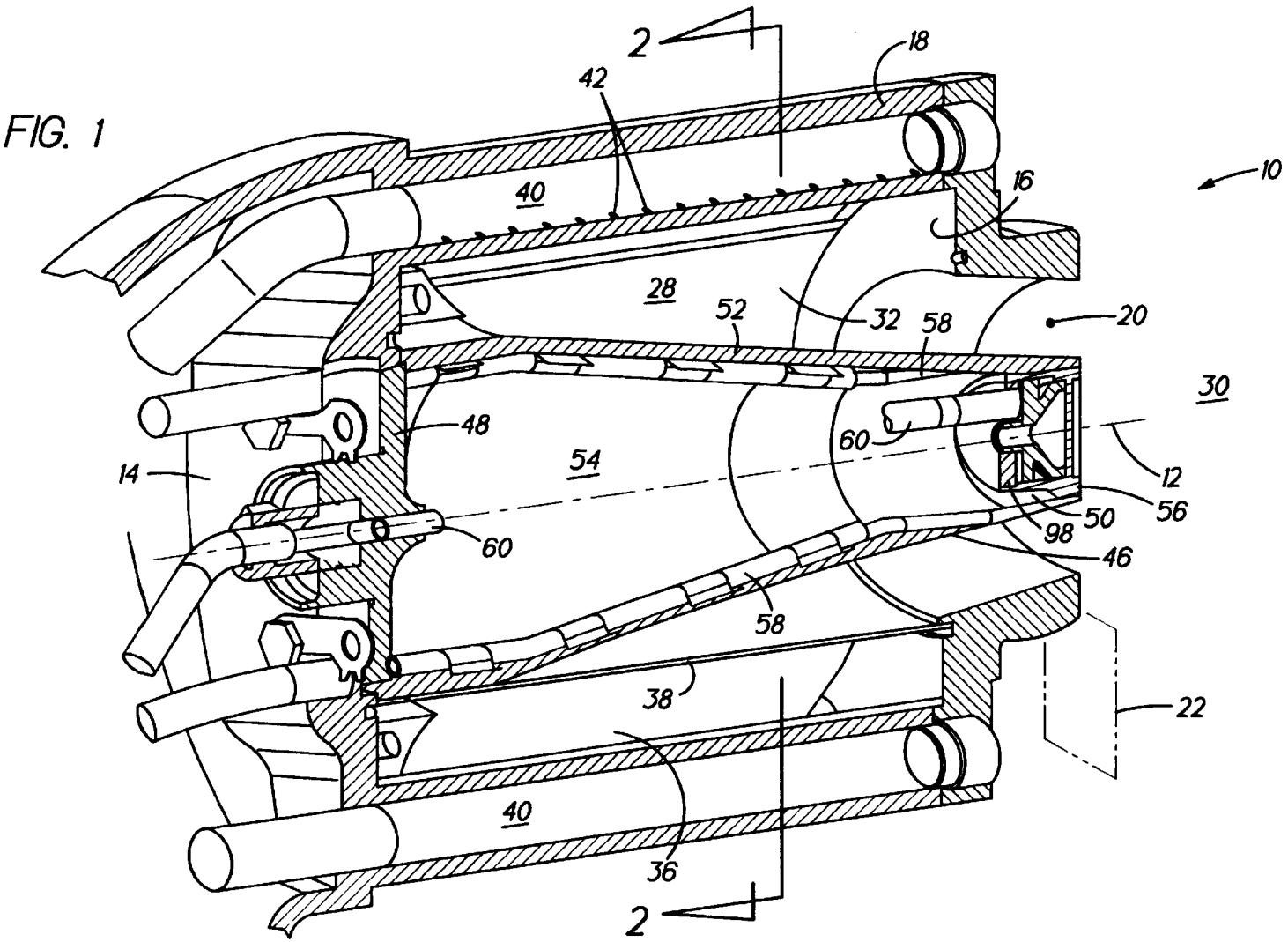
FIG. 1 is a perspective view of a premixing, tangential entry fuel injector of the present invention partially cut away to expose the interior components of the injector.
Figure 5:
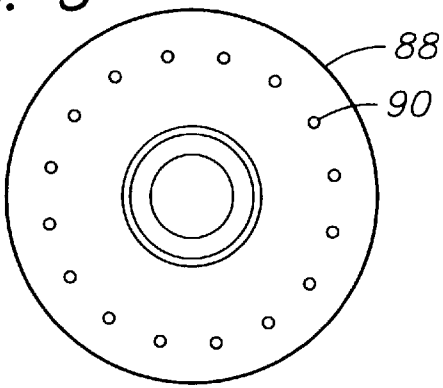
FIG. 5 is a view taken substantially in the direction 5—5 of FIG. 3 showing an orifice plate with an array of orifices extending therethrough.
Figure 6:
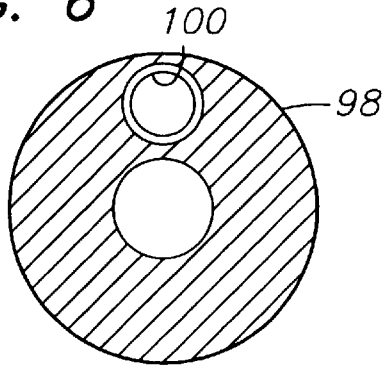
FIG. 6 is a view taken substantially in the direction 6—6 of FIG. 3 showing a plug with an aperture for receiving a secondary fuel supply tube.
Figure 4:
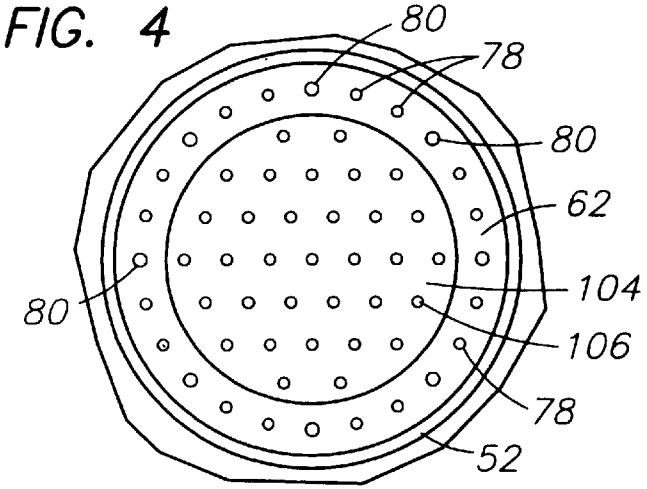
FIG. 4 is an end view taken substantially in the direction 4—4 of FIG. 3 showing arrays of discharge passages in the fuel injector nozzle.
Figure 7:
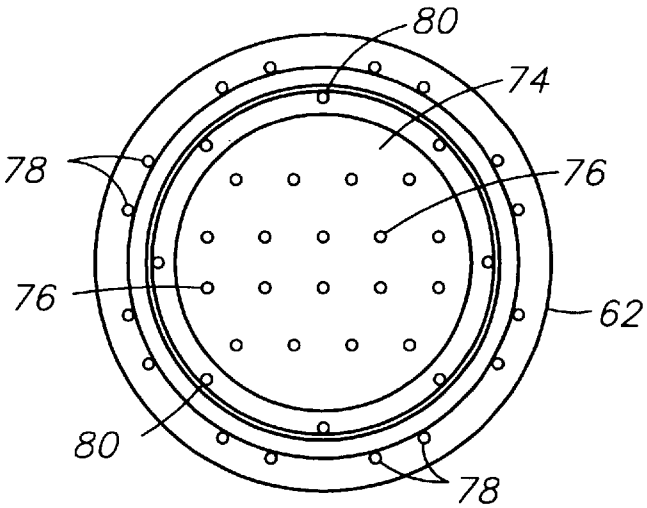
FIG. 7 is a view taken substantially in the direction 7—7 of FIG. 3 showing an impingement plate with an array of impingement ports extending therethrough.

Referring to FIGS. 1 and 2, a premixing fuel injector 10 having an axially extending fuel injector centerline 12 includes a forward endplate 14 an aft endplate 16, and at least two arcuate scrolls 18 extending axially between the endplates. A fuel injector discharge port 20 extends through the aft endplate, and the aft extremity of the discharge port defines a fuel injector discharge plane 22. The scrolls and endplates bound a mixing chamber 28 that extends axially to the discharge plane and within which fuel and air are premixed prior to being burned in a combustion chamber 30 aft of the discharge plane 22.

The scrolls 18 are radially spaced from the fuel injector axis 12, and each scroll has a radially inner surface 32 that faces the fuel injector centerline and defines the radially outer boundary of the mixing chamber. Each inner surface is an arcuate surface, and in particular is a surface of partial revolution about a respective scroll axis 34*a*, 34*b* situated within the mixing chamber. As used herein, the phrase "surface of partial revolution" means a surface generated by rotating a line less than one complete revolution about one of the centerlines 34*a*, 34*b*. The scroll axes are parallel to and equidistantly radially offset from the fuel injector centerline so that each adjacent pair of scrolls defines an air entry slot 36 parallel to the injector centerline for admitting a stream of primary combustion air into the mixing chamber. The entry slot extends radially from the sharp edge 38 of a scroll to the inner surface 32 of the adjacent scroll.

At least one and preferably all of the scrolls include a fuel supply manifold 40 and an axially distributed array of substantially radially oriented fuel injection passages 42 for injecting a primary fuel (preferably a gaseous fuel) into the primary combustion air stream as it flows into the mixing chamber.

The fuel injector also includes a centerbody 46 that extends aftwardly from the forward endplate. The centerbody has a base 48, a nozzle 50 and a shell 52. The shell extends axially from the base to the nozzle to define the radially inner boundary of the mixing chamber 28 and the radially outer boundary of a secondary air supply conduit 54. The base 48 includes a series of secondary air supply ports, not visible in the figures, to admit secondary air into the conduit 54. The aft end 56 of the nozzle (seen in more detail in FIG. 3) is bluff, i.e. it is broad and has a flat or gently rounded face, and is substantially axially aligned with the discharge plane 22.

A secondary fuel supply tube 60 extends through the centerbody to supply secondary fuel to the nozzle. In the preferred embodiment the secondary fuel is a gaseous fuel. Thermocouples (not visible) are housed within thermocouple housings 58 secured to the inner surface of the centerbody shell. A temperature signal provided by the thermocouples detects the presence of any flame inside the mixing chamber so that an automatic controller can initiate an appropriate corrective action, such as temporarily adjusting the fuel supply.

Referring now to FIGS. 3–7, the nozzle 50 includes a housing 62 having a tubular shroud portion 64 extending axially from a forward end 66 to a radially enlarged rim 68 at the shroud aft end 70. Perimeter air discharge passages 78 and perimeter fuel discharge passages 80 extend through the housing 62. As seen best in FIG. 4, sixteen perimeter air passages are circumferentially interspersed with eight equiangularly distributed perimeter fuel discharge passages. Each air passage has an inlet end in communication with the secondary air supply conduit 54 and an outlet end in communication with the combustion chamber 30. The housing also includes an impingement plate 74 circumscribed by the shroud. An array of eighteen impingement ports 76 extends through the impingement plate.

An insert 82 is coaxially nested within and circumscribed by the housing. The insert has a hub 84 with a central opening that serves as a secondary air supply passageway 86 for admitting a stream of secondary air from supply conduit 54 into the interior of the nozzle so that the impingement plate 74 intercepts the secondary air stream. An orifice plate 88 that includes an array of sixteen orifices 90 projects radially from the hub to the housing. A conical, aftwardly diverging hub extension 94 projects from the hub to the housing. The housing, the orifice plate and the hub extension cooperate to define an annular fuel manifold 96 in communication with the perimeter fuel discharge passages 80.

A plug 98 is nested radially between the insert hub 84 and the housing 62 and is axially spaced from the orifice plate 88. The plug has an aperture 100 for receiving the fuel supply tube 60 for introducing secondary fuel into the nozzle. The plug, the housing, the hub and the orifice plate cooperate to define an annular fuel distribution chamber 102. The fuel distribution chamber is axially spaced from the fuel manifold by the orifice plate, and fluid communication between the chamber and the manifold is effected by the orifices 90.

A tip cap 104 having an array of thirty three core air discharge passages 106 is installed in the housing and axially spaced from the impingement plate 74 to define an air distribution chamber 108. As seen best in FIG. 3, the core discharge passages are in misaligned series flow relationship relative to the impingement ports 76.

In operation, a stream of primary air enters the mixing chamber tangentially through the entry slots 36. Primary fuel flows through the primary fuel injection passages 42 and into the tangentially entering air stream. The air stream sweeps the fuel into the mixing chamber 28 where the air and fuel swirl around the centerbody 46 and become intimately and uniformly intermixed. The swirling fuel-air mixture flows through the injector discharge port 20 and enters the combustion chamber 30 where it ignites and burns.

Meanwhile, a stream of secondary air flows through the secondary air supply conduit 54 and enters passageway 86, which guides the secondary air into the interior of the nozzle housing 62. The secondary air then spreads out radially in conical portion 87 of the passageway 86, is intercepted by the impingement plate 74, and flows through the impingement ports 76. The air experiences a large total pressure drop as it flows through the impingement ports so that the air exits the ports as a series of high velocity impingement jets. The impingement jets flow across across the air distribution chamber 108 and impinge on the tip cap 104 to impingement cool the cap. The air then flows through the core air discharge passages 106 in the tip cap to transpiration cool the cap. The pressure loss across the core discharge passages is only about one fourth of the pressure loss across the impingement ports. Accordingly, the air discharges from the core discharge passages with a velocity smaller than that of the impingement jets. In the illustrated embodiment, the core discharge passages are substantially parallel to the fuel injector centerline 12, however the passages could be oriented obliquely to enhance the effectiveness of the transpiration cooling.

A stream of secondary fuel flows from the fuel supply tube 60, into the fuel distribution chamber 102 and ultimately into the combustion chamber 30 by way of the orifices 90, fuel manifold 96 and perimeter fuel discharge passages 80. The orifices offer appreciable resistance to the flow of fuel so that the fuel becomes uniformly spatially (i.e. circumferentially) distributed in the distribution chamber 102 before flowing into the manifold 96 and the combustion chamber 30. If the orifice plate were not present, the perimeter fuel discharge passages circumferentially proximate to the supply tube would be preferentially fueled while the passages circumferentially remote from the supply tube would be starved. The resultant nonuniform fuel distribution in the combustion chamber would promote NOx formation.

The fuel injector of the present invention offers a number of advantages over more conventional injectors whose fuel-air injection nozzles are exclusively transpiration cooled. When installed in a 25 megawatt class turbine engine used for producing mechanical or electrical power, the temperature of the end cap is about 100° F. cooler than the centerbody tip temperature of a more conventional injector. The disclosed injector achieves this temperature reduction despite using about 55% less cooling air than a more conventional injector. The reduced cooling air quantity contributes to a modest reduction in CO emissions (about 2 parts per million) at full engine power and a more significant reduction (about 30 parts per million or about 50%) at about 80% power. In addition, the velocity of air discharged from the core discharge passages is reduced by about 68%. The reduced velocity encourages the combustion flame to remain firmly anchored to the tip cap so that the problems associated with aero-thermal acoustic resonance are avoided, and flame ingestion into the mixing chamber is resisted.

Although this invention has been shown and described with reference to a detailed embodiment, it will be understood by those skilled in the art that various changes in form and detail may be made without departing from the invention as set forth in the accompanying claims.

I claim:

1. A fuel injector for a gas turbine engine combustion chamber, comprising:

at least two arcuate scrolls each having an axis substantially parallel to and radially offset from a fuel injector centerline, the scrolls defining the radially outer boundary of a mixing chamber, each adjacent pair of scrolls also defining an air entry slot for admitting a stream of primary combustion air into the mixing chamber, at least one of the scrolls including an axially distributed array of primary fuel injection passages for injecting a primary fuel into the primary air stream;

a centerbody comprising a centerbody base, a nozzle, and a shell extending axially from the base to the nozzle to define the radially inner boundary of the mixing chamber and the radially outer boundary of a secondary air supply conduit, the nozzle including:

a housing having a shroud portion;

a secondary air supply passageway for guiding a stream of secondary air into the interior of the housing;

an impingement plate circumscribed by the housing shroud so that the impingement plate intercepts the secondary air stream, the impingement plate having an array of impingement ports extending therethrough; and a tip cap having an array of core discharge passages extending therethrough, the impingement ports and core discharge passages being in misaligned, series flow relationship so that secondary air exiting from the impingement ports impinges on the tip cap and flows through the core discharge passages to cool the nozzle.

2. The fuel injector of claim 1 wherein the secondary air experiences a first total pressure loss as it flows through the impingement ports and a second total pressure loss as it flows through the core discharge ports, the first pressure loss being larger than the second pressure loss so that the secondary air impinges on the tip cap at a first velocity and discharges from the core passages at a second velocity, the first velocity being higher than the second velocity.

3. The fuel injector of claim 2 wherein the first pressure loss is at least about four times as great as the second pressure loss.

4. The fuel injector of claim 1, comprising:

a fuel distribution chamber for receiving and spatially distributing a stream of secondary fuel;

a secondary fuel manifold spaced from the fuel distribution chamber by an orifice plate, the orifice plate having an array of orifices for establishing fluid communication between the distribution chamber and the manifold; and an array of perimeter fuel discharge passages extending from the fuel manifold and through the housing for injecting the secondary fuel into the combustion chamber.

5. The fuel injector of claim 4 wherein the housing includes a radially enlarged rim portion with an array of perimeter air discharge passages extending therethrough, each perimeter air discharge passage having an inlet end in communication with the secondary air supply conduit and an outlet end in communication with the combustion chamber, the perimeter air passages being interspersed with the perimeter fuel discharge passages.

6. The fuel injector of claim 4 wherein the secondary fuel is a gaseous fuel.

7. The fuel injector of claim 1, comprising:

an insert nested within the housing, the insert having a hub with a central opening that serves as the secondary air supply passageway, an orifice plate extending between the hub and the housing and having an array of orifices therethrough, and a hub extension also extending from the hub to the housing;

a plug nested radially between the hub and the housing and axially spaced from the orifice plate, the plug including an aperture for receiving a secondary fuel supply tube that introduces secondary fuel into the nozzle;

the plug, the insert and the housing cooperating to define an annular fuel distribution chamber and a fuel manifold with the orifices extending between the chamber and the manifold;

the housing having an array of perimeter fuel discharge passages extending from the fuel manifold and through the housing for injecting the secondary fuel into the combustion chamber.

8. The fuel injector of claim 7 wherein the housing includes a radially enlarged rim portion with an array of perimeter air discharge passages extending therethrough, each perimeter air discharge passage having an inlet end in communication with the secondary air supply conduit and an outlet end in communication with the combustion chamber, the perimeter air passages being interspersed with the perimeter fuel discharge passages.

9. The fuel injector of claim 7 wherein the secondary fuel is a gaseous fuel.

10. The fuel injector of claim 1 wherein the core passages are substantially parallel to the fuel injector centerline.

11. A nozzle assembly for a fuel injector, comprising:

a housing with a shroud portion having a forward end and an aft end, the aft end being a radially enlarged rim having an array of perimeter air discharge passages and an array of perimeter fuel discharge passages extending therethrough, the housing also including an impingement plate circumscribed by the shroud with an array of impingement ports extending through the impingement plate;

an insert, coaxial with the housing and circumscribed thereby, the insert including a hub, an orifice plate projecting from the hub to the housing, the orifice plate including an array of orifices, and an aftwardly diverging hub extension also projecting from the hub to the housing; the housing, the orifice plate and the hub extension defining an annular fuel manifold in communication with the perimeter fuel discharge passages, the hub including a central opening that defines a secondary air supply passageway for admitting secondary air into the nozzle;

a plug nested radially between the hub and the housing and having an aperture for receiving a fuel supply tube for introducing secondary fuel into the nozzle; the plug, the orifice plate, the hub and the housing defining a fuel distribution chamber connected to the fuel manifold by the orifices; and a tip cap circumscribed by the aft end of the housing and axially spaced from the impingement plate to define an air distribution chamber, the tip cap including an array of core air discharge passages, the core discharge passages and impingement ports being in misaligned, series flow relationship so that secondary air exiting from the impingement ports impinges on the tip cap and flows through the core discharge passages to cool the nozzle.

* * * * *